US009618159B2

(12) United States Patent
Gouvêa et al.

(10) Patent No.: US 9,618,159 B2
(45) Date of Patent: Apr. 11, 2017

(54) SYSTEM AND EQUIPMENT FOR DISPENSING A HIGH PRESSURE COMPRESSED GAS USING SPECIAL HYDRAULIC FLUID, SEMITRAILER COMPRISING VERTICAL OR HORIZONTAL GAS CYLINDERS

(71) Applicant: NEOGÁS DO BRASIL GÁS NATURAL COMPRIMIDO S.A., São Leopoldo, Caxias do Sul, RS (BR)

(72) Inventors: Carlos Pereira Gouvêa, Caxias do Sul (BR); Vagner Flores De Almeida, Caxias do Sul (BR)

(73) Assignee: NEOGAS DO BRASIL GAS NATURAL COMPRIMIDO S.A., Sao Leopoldo, Caxias do Sul, RS (BR)

( * ) Notice: Subject to any disclaimer, the term of this patent is extended or adjusted under 35 U.S.C. 154(b) by 190 days.

(21) Appl. No.: 14/584,298

(22) Filed: Dec. 29, 2014

(65) Prior Publication Data

US 2016/0123535 A1 May 5, 2016

(30) Foreign Application Priority Data

Oct. 30, 2014 (BR) ..... 102014027157

(51) Int. Cl.
*F17C 5/06* (2006.01)

(52) U.S. Cl.
CPC ..... *F17C 5/06* (2013.01); *F17C 2221/033* (2013.01); *F17C 2223/0123* (2013.01); *F17C 2225/0123* (2013.01); *F17C 2227/0192* (2013.01); *F17C 2250/0443* (2013.01); *F17C 2260/02* (2013.01); *F17C 2270/01* (2013.01)

(58) Field of Classification Search
CPC .... F17C 5/06; F17C 223/012; F17C 2227/00; F17C 2227/0128; F17C 2227/0192; F17C 2270/013; F17C 2260/02
USPC ..... 141/3, 20, 25, 26; 222/394
See application file for complete search history.

(56) References Cited

U.S. PATENT DOCUMENTS 5,253,682 A * 10/1993 Haskett ..... F04B 9/107 141/197
5,454,408 A * 10/1995 DiBella ..... F04B 9/1176 141/18
5,603,360 A * 2/1997 Teel ..... F17C 5/06 137/267
5,676,180 A * 10/1997 Teel ..... F17C 5/06 137/267
5,908,141 A * 6/1999 Teel ..... F17C 5/06 141/18

(Continued)

*Primary Examiner* — Timothy L Maust
(74) *Attorney, Agent, or Firm* — Squire Patton Boggs (US) LLP

(57) ABSTRACT

The present invention relates to a system and equipment for dispensing a high pressure compressed gas using a special hydraulic fluid, comprising a hydraulic pressurization unit also known as "HPU", which can be connected to a semi-trailer comprising compressed gas cylinders, upper and lower open ends, comprising a single valve arranged at the upper end of the cylinders, which supplies the compressed gas to a customer, one valve disposed at the lower end of the cylinders for both supplying of the hydraulic oil from an oil reservoir to the cylinders, and the return of the hydraulic oil to the hydraulic fluid reservoir from the cylinders.

2 Claims, 6 Drawing Sheets

(56) References Cited

U.S. PATENT DOCUMENTS

| | | | | |
|---|---|---|---|---|
| 8,281,820 | B2 * | 10/2012 | White | F17C 5/02 141/37 |
| 2009/0293988 | A1 * | 12/2009 | Pang | F17C 5/06 141/59 |
| 2009/0294470 | A1 * | 12/2009 | Lampe | F17C 5/02 222/1 |
| 2010/0059138 | A1 * | 3/2010 | Shi | F17C 5/06 141/5 |
| 2010/0320224 | A1 * | 12/2010 | Lampe | F17C 13/00 222/1 |
| 2016/0215796 | A1 * | 7/2016 | Gouvea | F15B 11/072 |

* cited by examiner

SYSTEM AND EQUIPMENT FOR DISPENSING A HIGH PRESSURE COMPRESSED GAS USING SPECIAL HYDRAULIC FLUID, SEMITRAILER COMPRISING VERTICAL OR HORIZONTAL GAS CYLINDERS

BACKGROUND

Field

The invention refers to a system and equipment to allow the transport and delivery of natural gas to a station or areas not supplied by gas pipelines. The invention combines a storage system and a hydraulic pressure system to allow transferring up to 95% of the stored gas from a storage cylinder to the customer with a pressure constant up to the end of the dispensing process.

Description of the Related Art

There are many known ways to transport natural gas. Due to its physical characteristics, natural gas does not liquefy even at high pressures. So, the natural gas transported at high pressure will be only at gaseous phase. Consequently, the relation of pressure parameters and the volume to be transported is very important for an economic gas transportation service. All materials of the construction must be specific for high pressure conditions and electrically classified areas.

Cryogenics is also used for gas transportation. In the case, the natural gas is liquefied at a very low temperature of about −161° C. and low pressure of less than 10 bar. The cryogenic transport is advantageous, as a cryogenic tank is capable to store a gas volume much higher in comparison to a high-pressure gas cylinder of equivalent volume capacity. However, the gas liquefying process presents technical problems. The natural gas liquefying process is very critical point. Although being a well known technology, it requires the use of specific materials, which has a higher cost due to the extremely low temperature condition of the process. This increases the process cost. Another disadvantage is that the cost for producing liquefied natural gas (LNG) is proportionally too expensive in view of the produced LNG, such that, as less is the production of a LNG facility as higher is the production cost (US$/$m^3$ of produced LNG). This affects the application of the cryogenic technology for producing reduced amounts of LNG. Advantageously, our invention is economically feasible for producing reduced amounts, increasing its applicability.

Another technique involves the use of adsorbent material combined with pressure, wherein a pressure vessel or cylinder is filled with an adsorbent material. The authors Sidney Oliveira de Souza, Nelson Medeiros de Lima Filho and Cesar Augusto Moraes de Abreu—UFPE (Federal University of Pernambuco), in the article "Avaliação experimental do Processo de Carga para o Armazenamento de Gás Natural por Adsorção" states that the technology of Adsorbed Natural Gas (ANG) is being developed in the last decade, as a promising alternative for storing natural gas when compared to the CNG (compressed natural gas). The adsorption of natural gas on porous materials at relatively moderate pressures (60 to 80 bar) has many advantages in comparison to the CNG processes, as a large flexibility of design, construction and arrangement of a storage tank, increased safety and reduced costs. Although a promising technique, ANG is not commercially used, as it is still matter of research.

Finally, the most commonly storage of natural gas technique is the CNG, wherein the natural gas is compressed at high pressures and transported at gaseous phase to supply the customers. There are many possibilities for this service, as mentioned below.

The transport of compressed gas comprises cylinder pallets, wherein the compressed gas moves from pallet to pallet. They are individually filled in the compression station and the customer's pallets are changed as each pallet is consumed, as disclosed in Galileu's patents PI 0201043 and PI 0601501. However the solution proposed by Galileu is dangerous, as it is needed move pallets, which are too heavy.

The Gastron Comprimido S. A. patent PI 0604520 discloses a rigid structure for transporting cylinders storing fluids on the back of trucks attachable to a lifting system, which also describes the use of cylinder pallet.

The fractionated supply using cylinder pallets also has operational difficulties on the compression station. The use of such system reduces the amount of transported cylinders, decreasing the transported gas volume and increasing the cost per $m^3$ of transported gas.

Neogás Inc has developed new technologies of gas compression and transferring for the transportation of gas, such that the cylinders used do not comprise any moving parts besides a special hydraulic fluid composition which avoids the mixing of oil and gas.

Igor Krasnov's patent application PI 0208143-1 (WO 02075204) refers to a compressed natural gas system, which consists of a control section, a transfer section, and a refueling section. The control section has a control panel and a hydraulic fluid reservoir, which contains the synthetic hydrocarbon hydraulic oil. The transfer section comprises banks of high pressure storage cylinders. Each bank has an equal number of cylinders, which are identical in size. The hydraulic fluid ports of each cylinder in the cylinder bank are coupled in parallel to a fluid manifold, wherein each fluid manifold has a manual shut-off valve. The cylinders have a first end and a second end, wherein the second end is closed. The first end having an opening through which passes a fitting, which contains a hydraulic fluid port and a gas port. A tracer element, as a disc, is positioned within the cylinder chamber, between the CNG and the hydraulic fluid. The tracer element has a high cost and a maintenance of difficult execution, as it is inside the cylinder.

Such an arrangement also has other disadvantages, which are described below. Besides the difficult maintenance of the disc, the use of the fitting may increase the chances of forming an emulsion, i.e., a friction between the oil and the gas. The use of the fitting also results in a reduced flow rate, increasing the time of dispensing or refueling the gas. When using a relief valve to maintain a pressure of 24.8 MPa, the compressing system requires the use of a specific type of cylinder, limiting the pressure and restricting the use of the system.

Patent document PI0006389-4 describes a cascade system for natural gas supply. The claimed system consists of a control section, a transfer section and a refueling section. The control section consists of a computerized control panel and a hydraulic fluid reservoir. The transfer section comprises two banks of high pressure storage cylinders. Each bank has an equal number of cylinders, which are identical in size. Each cylinder contains an axially moveable piston pair of inlets on one end and an outlet at the other end. The piston separates the compressed natural gas from the hydraulic fluid. The inlets of the cylinders in each bank are arranged in parallel to the inlet pipes.

In a compression system, it is possible to use a booster system for withdrawing gas from larger containers, in order to reduce costs. In this type of system there is high energy consumption. The booster works at low pressures around 220 bar. The system developed by Neogas maintains the initial pressure of the container without needing to elevate pressure, which also improves the time requested for refueling a customer. An advantage for the customer is that the refueling temperature of our system is lower than the booster system, as our system only need to maintain the gas compressed at the same temperature, which is different from the booster system that raises the pressure, raising the temperature. Thus, our system allows dispensing more gas than with the booster.

Patent P10603687-2 A of Neogás do Brasil describes a system of gas compression in a compression station, transportation, and gas delivery at constant pressure maintained by a special composition of a hydraulic fluid. The system described in that patent overcomes the deficiencies found in the prior art, disclosing a hydraulic pressure equipment able to refuel motor vehicle, maintaining pressure at a constant level, in a efficient manner. However, the system presents the drawback of comprising a complex driving system of valves of high cost.

Therefore, there is a need in the state of the art for a system and equipment of gas supply simpler and less expensive.

Thus, in order to overcome the problem of the state of the art mentioned above, the present invention discloses an improved control of the valve system by modifying the valve system and pipes. The invention improves driving the pneumatically actuated valves in a fastest and more synchronized manner. The use of extra-light cylinders type IV is optional. Optionally, a closed-cycle return block system of natural gas may be used.

Before detail the invention, it is important to show that the possibilities of use for the system of the invention. Both natural gas as a treated biogas can be used with this system. For a better understanding, find below the definition of both cases.

Natural gas is a fossil fuel formed when layers of animals and plants are submitted to intense heat and pressure over thousands of years, under the soil. The energy of the sunlight naturally absorbed by plants is stored in the form of carbon in natural gas. It is a mixture of light hydrocarbons found in the subsoil, in which methane has a higher content of over 70% by volume. The composition of natural gas can vary greatly depending on factors relating to the field in which the gas is produced, production process, conditioning, processing, and transport. Natural gas is a fossil fuel and a non-renewable source of energy.

Biogas is the name usually given to any gas produced from biologically break of organic matter in the absence of oxygen. Typically consists of a gas mixture consisting mainly of methane ($CH_4$) and carbon dioxide ($CO_2$), with small amounts of hydrogen sulfide ($H_2S$) and humidity.

The biogas production occurs naturally in submerged locals where the atmospheric oxygen cannot penetrate, as in swamps, deep water bodies, intestine of animals, or in a anthropogenic condition, as in landfills and biogas plants.

SUMMARY

The present invention refers to a complete system of transport and compression through an HPU (Hydraulic Pressurization Unit) that is connected with a gas container, a STV (semitrailer vehicle), which can comprise vertical or horizontal gas cylinders adapted to use of technology developed to keep the pressure constant in the cylinders of the semitrailer during the fueling operation. The invention consists of a simplified system and hydraulic pressurization equipment. The here disclosed oil filling system, oil return system and reduced number of pneumatically actuated valves provides an easy and fast control of the system by synchronizing the start thereof, which improves the system performance having more accurate response to the control actions. The simplified control system also reduces the maintenance problems.

In the gas pressurization system already known, the oil filling and return of a HPU for STV is performed in two lines, one for sending the oil and other for return the oil, as taught in PI0603687-2 patent document. Each pallet is a set of cylinders interconnected by pipes, which requires a manual shut-off valve and two compressed air actuated valves. Therefore, the system comprises many valves, which requires a significant portion of space in each pallet to accommodate all valves, reducing the space available to receive the cylinders and consequently, reducing the capacity of gas transport.

The equipment that is herein described comprises a stationary module consisting of an electric motor, a coupling, a hydraulic pump, a hydraulic reservoir of a special hydraulic fluid, an oil supplying block, an oil return block and cylinder pallets.

The pallets of the container pallets consist of a cylinder or a set of cylinders, wherein each cylinder has two necks for connecting to the system. At the outlet end there is one ball valve connected to the natural gas outlet line and the inlet end comprises only one ball valve, wherein one of the valve ends is connected in parallel; one of the other ends is connected to the supplying line and the other end is connected to the return line. The special hydraulic fluid is pumped through the supplying line from the reservoir to the inlet end of the cylinder to maintain a pressure of 220 bar in the cylinder, while CNG is supplied to the consumer.

The supply process initiates by filling the container of pallets in a natural gas fueling station. The cylinders are filled under a filling pressure compatible with the cylinder design. Transportation is carried out by a semi-trailer vehicle, which moves to a natural gas fueling station, where a HPU is installed. The gas container is interconnected to the HPU module via three hoses.

The driving element is the oil pump and the special hydraulic fluid transfer the pump energy to the gas to provide a constant pressure of 220 bar. When the gas is dispensed from the cylinder, the pressure tends to fall. Thus, the fluid enters into the cylinders to keep the pressure constant, while the gas is removed from the cylinder. When there is no longer enough gas to be removed from this pallet, the fluid is sent back to the oil reservoir. Note that, the oil is sent to the pallet and returned to the oil reservoir through the same pipe. The oil returns to the oil reservoir under gas pressure, which moves the oil back to the reservoir, remaining only a residual pressure in the cylinder.

Simultaneously, the PLC (programmable logic controller) of the HPU controls the delivery of hydraulic fluid to the second pallet of cylinders.

The end of each cycle occurs when the volume of gas sent corresponds to 95% of the total volume of the pallet. At this time, the gas outlet valve is closed, the oil begins to return, forced by gas pressure, and moves bach to the oil reservoir. A ruler installed in the oil tank controls the delivered gas volume and the returned oil volume. This information is processed in the PLC that monitors all events occurring in the equipment, automatically controlling the operations while maintains a manual operative option.

DETAILED DESCRIPTION

The invention will be described in reference to FIGS. 1 to 6, as follows.

HPU is a module of hydraulic high pressure generation using a hydraulic fluid of special composition, which is interconnected with a movable container comprising vertical or horizontal cylinders to supply natural gas to a customer. HPU has multiple flows according to the available supply need.

| HPU | Oil rate liters/minue | NG rate $m^3/h$ | Required energy $Kwh/m^3$ |
|---|---|---|---|
| 200 | 13.5 | 215 | 0.028 |
| 350 | 21.5 | 342 | 0.027 |
| 600 | 34 | 539 | 0.027 |
| 800 | 45 | 720 | 0.027 |
| 1050 | 67.42 | 1080 | 0.028 |
| 1600 | 101.4 | 1618 | 0.028 |
| 2200 | 140 | 2247 | 0.028 |

Note:
$m^3$ at 20° C. and 1 atm.

The whole system has a number safety devices, including redundant safety devices. All cylinders have safety devices for exceeding pressure and temperature. The high pressure oil line has a pressure relief valve.

The entire system is designed according to strict security criteria. The suction and oil discharge lines are designed for 350 bar, although they operate with a much lower pressure.

This technology allows transfer up to 95% of the gas that is stored at constant pressure of at least 220 bar.

Figure 1:
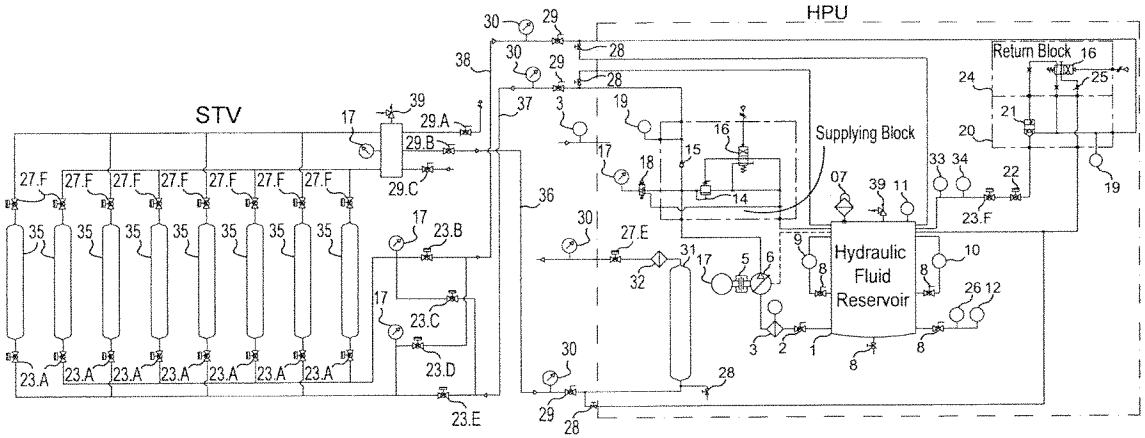
FIG. 1—illustrates a schematic diagram of the HPU system and STV, according to the invention.

FIG. 1 illustrates a HPU (hydraulic pressurization unit) connected to a STV (semi-trailer vehicle). During the system operation, the hydraulic fluid from the hydraulic oil reservoir 1 of the HPU is compressed and directed to cylinders 1A, 2A, 3A, 4A, 5A, 6A, 7A and 8A of the STV via the hydraulic fluid supplying line 37.

Figure 2:
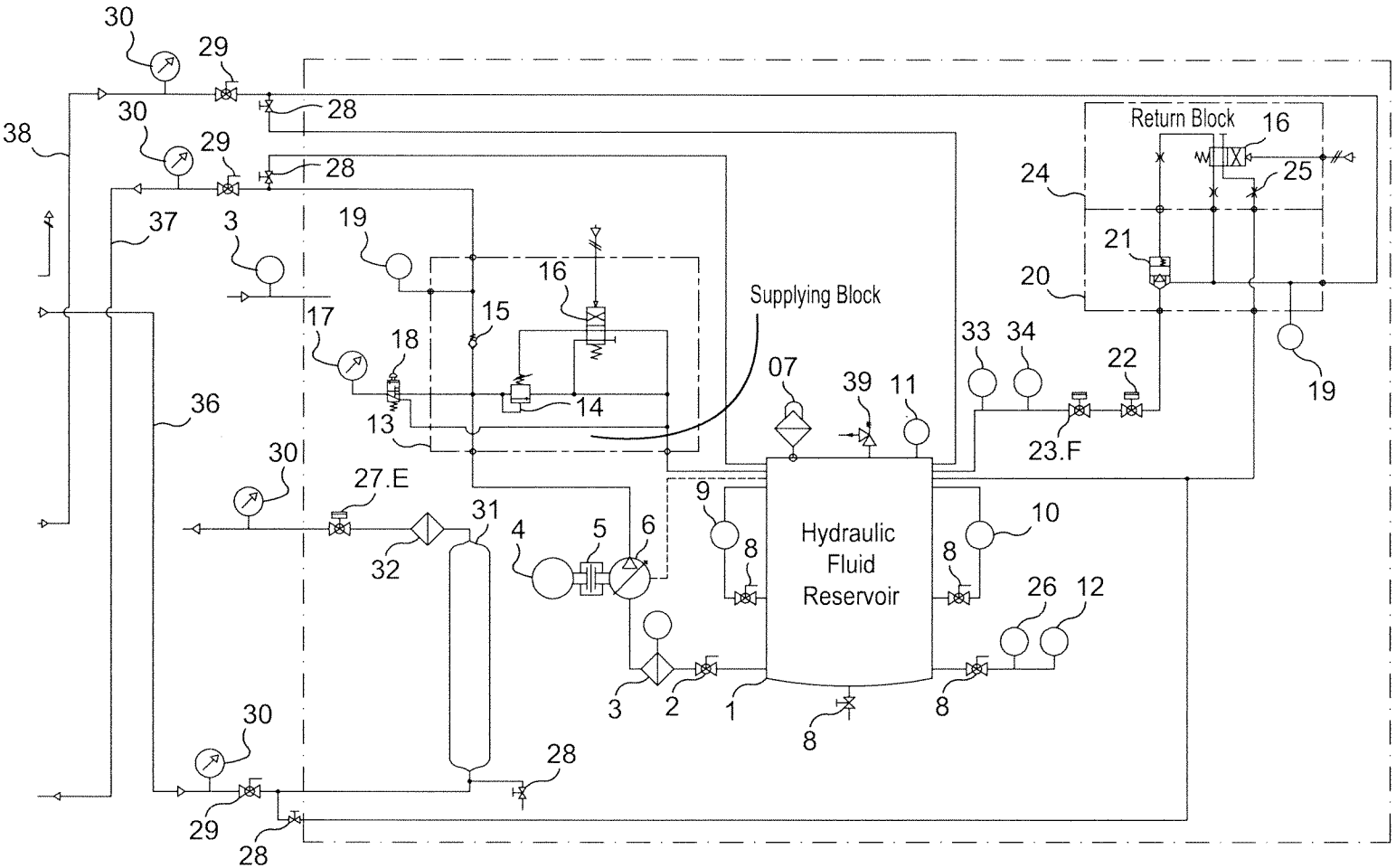
FIG. 2—illustrates a schematic diagram of the HPU.

FIG. 2 shows a HPU comprising the entire hydraulic system, including an oil reservoir 1, a motor 4 with a coupling 5 of the hydraulic pump 6, an oil supplying block 13, an oil return block 20. The entire system is controlled by an electrical control panel by a PLC (not shown).

Figure 3:
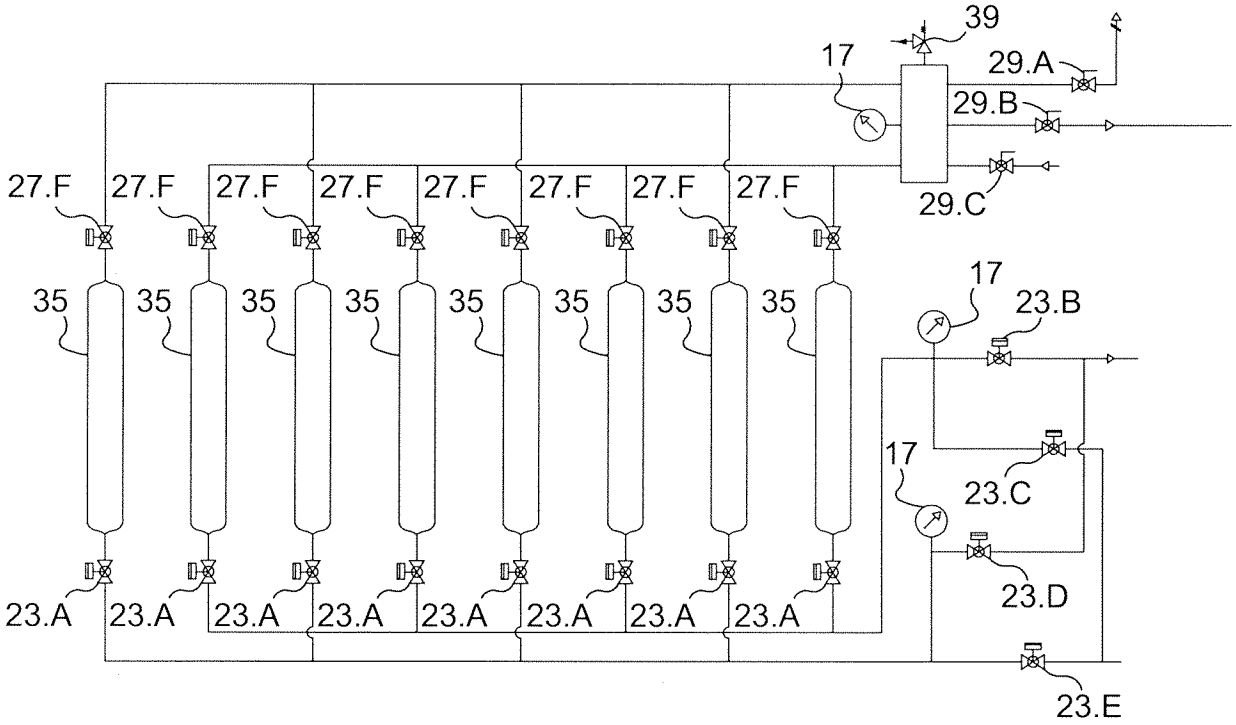
FIG. 3 illustrates a schematic diagram of the STV.

FIG. 3 shows a STV comprising a set of cylinder pallets, here represented here by the pallets 1A, 2A, 3A, 4A, 5A, 6A, 7A and 8A. However, it should be understood that each pallet may comprise a horizontal cylinder or a set of cylinders. As shown in FIGS. 1 and 3, each gas cylinder comprises a single valve 23A in one of the open ends of the cylinder allowing both the inlet of the hydraulic oil from the hydraulic oil reservoir 1 to the cylinders as the return of the oil to the reservoir.

The operation of equipment is based on the compression of a hydraulic fluid of special composition. The fluid is stored in the oil reservoir 1 of 3,000 liters of volume capacity. The oil passes through the shut-off valve 2 and the filter 3 to the pump 6 and electric motor 4 of the HPU. They are interconnected by a coupling 5, which allows the rotation transmission to the oil pump. The oil already compressed is directed to the supplying block 13. The pressure is regulated by the relief valve 14. The directional valve 16 is actuated by compressed air, activating the pressure regulation. When no air is actuating on the directional valve 16, the direct passing-through position, the relief valve 14 is not actuated, causing the oil to recirculate in the system without enough pressure to overcome the spring force of the check valve 15. When the directional valve 16 is actuated, it acts directly on the spring relief valve 14, directing the oil to the system in a previously set pressure.

The oil flows passing through the check valve 15 and then, the pressure is measured continuously by a pressure transmitter 19. The pressurized oil flows through the supplying line 37 of hydraulic fluid line, passing through the valve 29 and gauge 30 to the valve system with pneumatic actuator 23E and 23C. The valves 23E and 23C allow control the supplying of hydraulic fluid to the pallet comprising the gas cylinders using two oil inlet lines connected to the inlet end of the cylinders which comprises only one valve 23A.

When 95% of the gas contained in the cylinders (1A, 2A, 3A, 4A, 5A, 6A, 7A and 8A) is transferred to the customer, that is, when the volume of hydraulic fluid reaches 95% of the capacity of each compressed gas cylinder, the valves 23B and 23D allow the hydraulic fluid to return to the oil reservoir 1. Then, the hydraulic fluid returns from the cylinder to the reservoir 1 passing through the same valve 23A and pipes to the valves and 23B 23D which allow the hydraulic fluid to pass to the oil return line 38, as shown in FIGS. 1, 2 and 3.

In the systems of compressed gas supply of the prior art, each pallet comprises 02 valves connected to a hydraulic fluid inlet end, wherein one valve controls the oil inlet into the cylinder and the other valve controls the oil return to the hydraulic fluid reservoir. Now, with the present invention, both oil inlet of the cylinder 1A, 2A, 3A, 4A, 5A, 6A, 7A and 8A as the oil return to the hydraulic fluid reservoir 1 is carried out by means of a single valve 23A, which connects the inlet end of each cylinder (1A, 2A, 3A, 4A, 5A, 6A, 7A and 8A) to the oil flow pipes.

The inclusion of the four valves 23 (B, C, D and E) in this compressed gas supply system allows to install only one valve 23A at the inlet end of the cylinder. Furthermore, the arrangement of valves 23 (B, C, D, E) together allow the manual control of the system in a synchronized faster manner.

Thus, the invention consists of a pipe and valve arrangement, which reduces the number of valves, reducing cost and making space in the container that enables the transport of more cylinders and consequently, the transport of an increased amount of gas, considering that the two valves per pallet system causes the amount (of what?) is such that a tunnel is reserved path between the cylinders. The systems of the prior art comprise two valves per pallet, such that a passageway or corridor between cylinders is needed.

The main advantage achieved with this system is the better control of the HPU. The reduced number of valves and the arrangement of the four valves 23 (B, C, D, E) together, in place of a pair of valves on each pallet, provides a faster starting of the system, as well as, a synchronized opening and closing of valves. The reduced number of valves reduces the number of maintenance events. The supply and the return of oil between the HPU and the STV of the delivery systems of compressed gas of the prior art comprise two pipe lines, one for supplying the oil and the other to return the oil. The present system now uses a single valve 23A and only one oil pipe line to perform both supply and return of the oil between the HPU and STV. Although the good performance of the compressed systems of the prior art, these systems requires a manual shut-off valve and two compressed air actuated valve for each pallet. Such a system therefore contains an excessive number of valves, and requires significant space to receive all valves, reducing the place available in the STV, which could be used to transport more compressed gas cylinders. The system here disclosed uses two lines, both being used to supply hydraulic oil, as well as, to return hydraulic fluid to the oil reservoir, feeding different groups of pallets. While one pipe line connects the pallets 1A, 3A, 5A, 7A, 9A, the other pipe line connects the pallet 2A, 4A, 6A, 8A, etc.

Therefore, the valves 23 B, C, D and E control the supply of the pallets, which are electronically control by the PLC, as taught in P10603687-2 document and therefore will not be discussed in more detail.

When the valves 23 B and E are open, the valves 23 C and 23 D are closed. The valve 23 E flows from the oil reservoir 1 to the cylinders 1A, 3A, 5A and 7A, while the valve 23 B flows from the pallet to the oil reservoir 1. The valves 23 B and E acts together. When the set of cylinders 1A, 3A, 5A and 7A is almost completely discharged, the valves 23 B and E close and the valves 23 C and D open, wherein the valve 23 C directs the oil from the pallets to oil reservoir and the valve 23 D flows from the hydraulic oil reservoir to the pallets, starting the transferring of gas from the set of compressed gas cylinders 2A, 4A, 6A and 8A to the customer, followed by the return of the hydraulic oil to the reservoir 1.

When receiving or returning oil, each respective pneumatically actuated valve 23 A of each respective pallet is opened whereas all the other valves 23 A are closed. Once the pallets are changed in use, their respective valves 23 A open when in use and close when not operating.

The pallet which is returning oil to the reservoir, the oil passes through a high pressure return line 38. The oil after the discharging of 95% of the gas contained in the pallet to the customer. The pressurized oil supplied to the pallet can compress the gas, maintaining the pressure constant inside the cylinder. The system changes from a pallet to another by closing the pneumatically actuated valve 27 F. The set of pneumatically actuated valves 23 change from the open to the closed position. The valves 23B and 23E close and the valves 23C and 23D open. The oil flows through the pipe 37 toward the pallet of cylinders, whereas the oil flows through the pipe 38 oil toward the oil reservoir.

The pneumatically actuated valves 22 and 23F acts together. First, the oil passes through the valve 22, which passage is defined by a calibrated opening, and then through the valve 23F. The 23F valve does not have the calibrated opening. The PLC controls the operation. When the oil begins to return, the pneumatically actuated valves 22 and 23F open. Once the oil rate flow begins to decrease the valve 22 having the calibrated opening opens (this valve is completely opened, such that the flow does not pass through the calibrated opening).

There are two optical sensors located upstream the oil hydraulic reservoir. The first photo electric sensor 34 and the photoelectric pen sensor 33 checks the oil flow. The sensors verify if only oil is flowing to the reservoir or gas is also flowing along with the oil flow to the reservoir. The oil return occurs in repeated cycles such that a maximum amount of oil from is removed from the pallet.

While the bottom of the pallet manages oil, the upper part of the pallet manages the natural gas. Each pallet has a pneumatically actuated valve 23, which closes or opens the pallet.

The disclosed system may be used with two types of cylinder, namely, a cylinder made of steel or cylinder type 4.

The pressure within the pallet cylinders remains constant, even when the gas flows out of the container through the upper part of the cylinder, due to the oil injection on the bottom part of the cylinder. The system maintains this balance, i.e., the hydraulic system aligns properly the actuated valves 23 C and E in order to deliver the natural gas to a customer. The customer may be a vehicle, a storage container or similar. The compressed natural gas flows through a block where there is a relief valve 39, a connection for filling of a container 29A, an outlet to the refueling line of the customer 29B, and a vent valve 29C that allows disconnecting the hoses.

The high pressure line 36 of natural gas conducts the gas to the cylinder 31 which allows the gas to expand and then condensing part of the content from the pallet, which forms a liquid material. The gas flows out the cylinder passing through a filter 32 following to a pneumatically actuated valve 27 and finally passing through a pressure gauge 30.

Figure 4A:
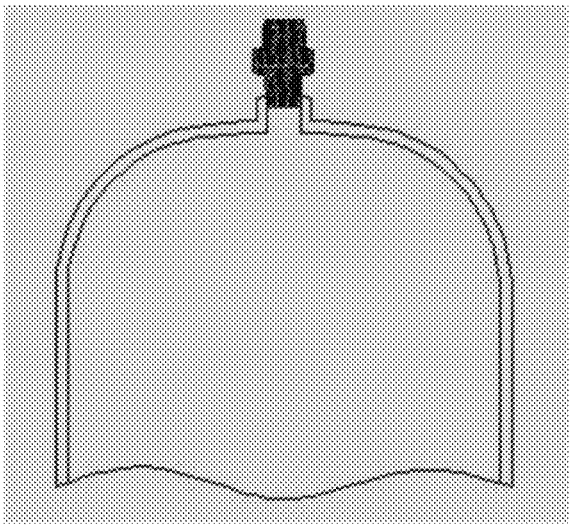
FIG. 4A—illustrates an internal detail of the gas inlet disposed on the top part of a vertical cylinder.
Figure 4B:
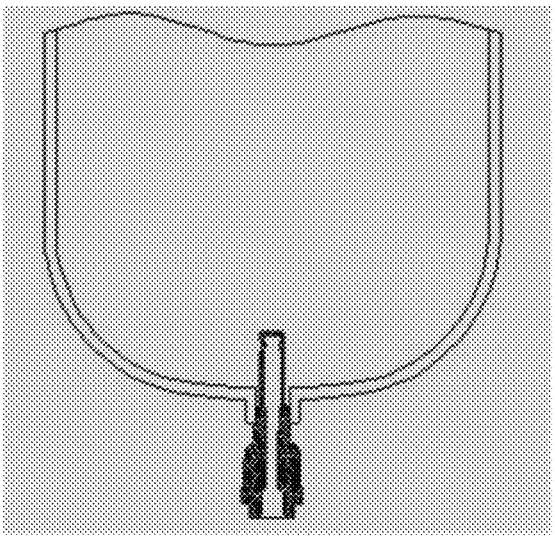
FIG. 4B—illustrates an internal detail of the inlet/outlet of flow disposed on the inferior part of a vertical cylinder.
Figure 4C:
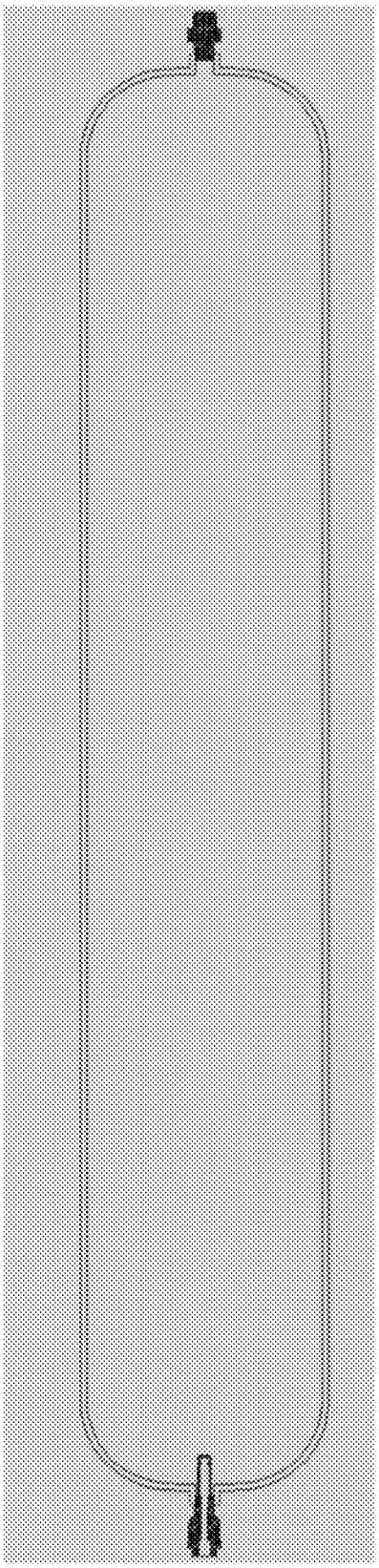
FIG. 4C—illustrates a cylinder with the fittings of FIGS. 4A and 4B.

FIGS. 4A, 4B and 4C illustrate, respectively, the internal detail of the gas inlet and the internal details of flow inlet/outlet of the hydraulic fluid located in the upper part of a vertical cylinder of the prior art, which can be used together with the gas supply system of the present invention. FIG. 4C illustrates the cylinder connected to the fitting shown in FIGS. 4A and 4B.

Figure 5A:
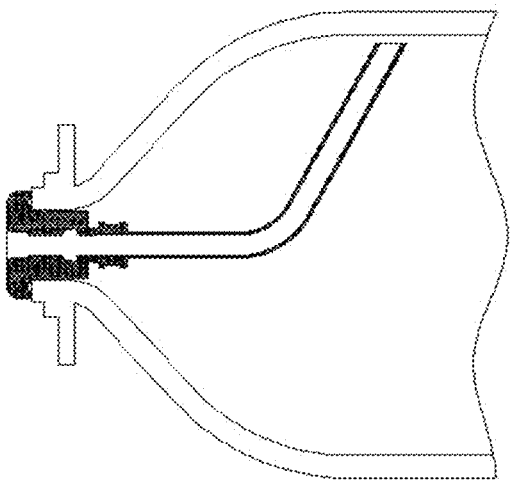
FIG. 5A—illustrates an internal detail of the gas inlet disposed on the top part of a horizontal cylinder.
Figure 5B:
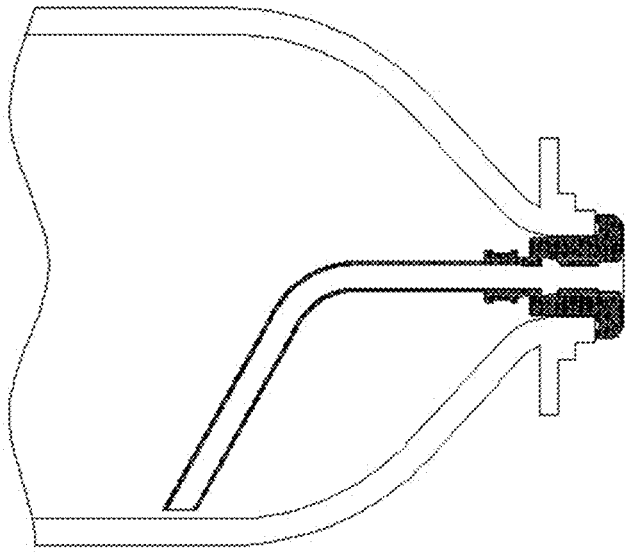
FIG. 5B—illustrates an internal detail of the inlet/outlet of flow disposed on the inferior part of a horizontal cylinder.

FIGS. 5A and 5B respectively show the internal detail of the gas inlet and the internal details of flow inlet/outlet of the hydraulic fluid located in the upper part of the horizontal cylinder already disclosed in patent document PI0603687-2, which can be used with the gas supply system of the present invention.

The fittings in FIGS. 5A and 5B are curved fittings for use in horizontal cylinder. The fittings of both ends of the horizontal cylinder consist of a curved tube of a determined curvature radius according to the curvature radii of the cylinder ends. The function of the fitting shown in FIG. 5A is to increase the efficiency of the compressed gas delivery in order to avoid the CNG gas receiving lines to receive hydraulic fluid. The function of the fitting shown in FIG. 5B is to provide a uniform oil flow introduced in the cylinder preventing oil flow bursts inside the cylinder.

It is noted that the present invention is not limited to the above description and the invention encloses any modification performed within the same inventive concept and scope of protection defined in claims.

The invention claimed is:

1. A system for dispensing a high pressure compressed gas using hydraulic fluid, comprising a hydraulic pressurization unity (HPU), a semitrailer comprising compressed gas cylinders, wherein each of the compressed gas cylinders comprises an open lower end for receiving a hydraulic fluid and open upper end for dispensing the compressed gas to a customer, wherein the HPU comprises:

an oil reservoir connected to a pump assembly and an electric motor, which moves the hydraulic fluid to a supplying block;

the supplying block comprising of a directional valve, a relief valve, a check valve, and a pressure transmitter able to drive the hydraulic fluid from the oil reservoir to the compressed gas cylinders through a supplying pipe, which then drives the compressed gas out of the compressed gas cylinders; and photoelectric sensors, pneumatically actuated valves, a first passage valve having a opening, and a second passage valve, which does not have the opening, being able to return the hydraulic fluid to the oil reservoir, through a returning pipe after removing of 95% of a volumetric capacity of each of the gas cylinders, wherein the compressed gas cylinders of the semitrailer receive the hydraulic fluid from the oil reservoir through the supplying pipe, which connects to the open lower end of the cylinders of a pallet by a single control valve and the hydraulic fluid returns to the oil reservoir via the single control valve flowing through the returning pipe wherein the compressed gas cylinders of the semitrailer include:

only one valve at the open lower end of each of the compressed gas cylinders, wherein the valve at the open lower end controls both the supplying of hydraulic oil from the oil reservoir to the compressed gas cylinders through the supplying pipe, and the return of the hydraulic fluid from the compressed gas cylinders to the oil reservoir via the returning pipe;

only one valve at the open upper end of each compressed gas cylinder, wherein the valve at the open upper end controls the supplying of compressed gas to supply a customer; and a set of valves arranged separately from the compressed gas cylinders of the semitrailer, wherein the set of valves control the supply of the hydraulic fluid from the oil reservoir to the cylinders of a pallet reaching the valve disposed at the open lower end of each of the compressed gas cylinders, and wherein the set of valves control the returning of the hydraulic fluid through the returning pipe from the gas compressed cylinders passing through the valve at the lower open end of the gas compressed cylinders to the oil reservoir.

2. The system according to claim 1, wherein the compressed gas cylinders of the semitrailer can be formed by groups of vertical cylinders joined together or by a single horizontal cylinder.

* * * * *